US005140890A

United States Patent [19]

Elion

[11] Patent Number: 5,140,890

[45] Date of Patent: Aug. 25, 1992

[54] GUITAR CONTROL SYSTEM

[75] Inventor: Clifford S. Elion, Van Nuys, Calif.

[73] Assignee: Gibson Guitar Corp., Nashville, Tenn.

[21] Appl. No.: 467,490

[22] Filed: Jan. 19, 1990

[51] Int. Cl.[5] ..... G10H 3/18

[52] U.S. Cl. ..... 84/736; 84/742; 84/DIG. 9

[58] Field of Search ..... 84/723, 725, 726, 728, 84/735-738, 743, 645, DIG. 9, 742

[56] References Cited

U.S. PATENT DOCUMENTS 4,748,887 6/1988 Marshall ..... 84/646
4,817,484 4/1989 Iba et al. ..... 84/726
4,841,827 6/1989 Uchiyama ..... 84/622

*Primary Examiner*—William M. Shoop, Jr.
*Assistant Examiner*—J. Donels
*Attorney, Agent, or Firm*—Laney, Dougherty, Hessin & Beavers

[57] ABSTRACT

A guitar control system using multiple string processing channels for developing pitch and peak signals for a multiple of string vibrations. Pitch data is multiplexed into a microprocessor along with the peak data and the programmed microprocessor outputs processed sound information on an address/data buss. Midi input/output, analog input/output and counter circuitry are interactively connected with the data buss, and final audio processing is derived from the analog output.

5 Claims, 9 Drawing Sheets

GUITAR CONTROL SYSTEM

BACKGROUND OF THE INVENTION

1. Field of the Invention

The invention relates generally to guitar/MIDI type systems and, more particularly, but not by way of limitation, it relates to improved guitar synthesis systems having greater versatility and feel.

2. Description of the Prior Art

There is a great amount of recent prior art that relates to the playing of various musical instruments through a MIDI-musical instrument digital interface system wherein an instrument signal is derived, digitized and sound synthesized to produce an audio output. Various forms of effects may be mixed with the final output sound. There have been various types of guitar controllers developed in recent years; however, there are two basic types of guitar controllers that find wide commercial application. A first type is that which determines the pitch from the waveform of the guitar output. The second is a type which utilizes some other parameter to represent the pitch, i.e., usually the length of the string.

The first category usually makes use of a special pickup which is mounted on a normal guitar, as is the case in the present invention. It is deemed important to retain the "guitarness" or "feel" of the instrument and a retrofittable hexaphonic magnetic pickup is utilized with such a pitch detection system. A second category almost always requires that the instrument is a somewhat altered guitar. The guitar may have all strings of one gauge, or the neck may be wired so that there are electrical contacts on each fret, etc. Still other types of guitar source utilize sensors connected to the individual strings or other obstructions that compromise the visceral nature of playing the guitar.

SUMMARY OF THE INVENTION

The present invention includes a plurality of string processing channels for determining the pitch and the peak characteristics, one processing channel for each string of the guitar. The pitch signals are applied in parallel to an input multiplexing logic which prepares each of the pitch signals for input to a microprocessor or microcontroller, and the plurality of string peak signals are also applied as input to the microprocessor. The microprocessor then functions to process output data on a parallel buss supplied to each of a MIDI input-/output, an analog input/output and a counter. The MIDI circuitry then deals with the external synthesizer and other effects circuitry. The analog input/output provides a data output to audio processing circuitry and the counter circuitry develops a string filter timing count for return back to the string processing channels.

Therefore, it is an object of the present invention to provide a guitar signal controller suitable for use with any MIDI-equipped synthesizer.

It is also an object of the invention to provide a guitar sound controller that retains the guitarness and feel for playing the instrument.

It is still further an object of the present invention to provide a more versatile interface that allows the user to control synthesizer and effected guitar sounds from a single location.

It is yet another object of the invention to provide an improved method for measuring as many as twelve simultaneous pitch periods.

Finally, it is an object of the present invention to provide a new level of control for the guitar player wherein an effects loop controller can be integrated with the MIDI converter hardware and control interface.

Other objects and advantages of the invention will be evident from the following detailed description when read in conjunction with the accompanying drawings which illustrate the invention.

DETAILED DESCRIPTION OF THE INVENTION

Figure 1:
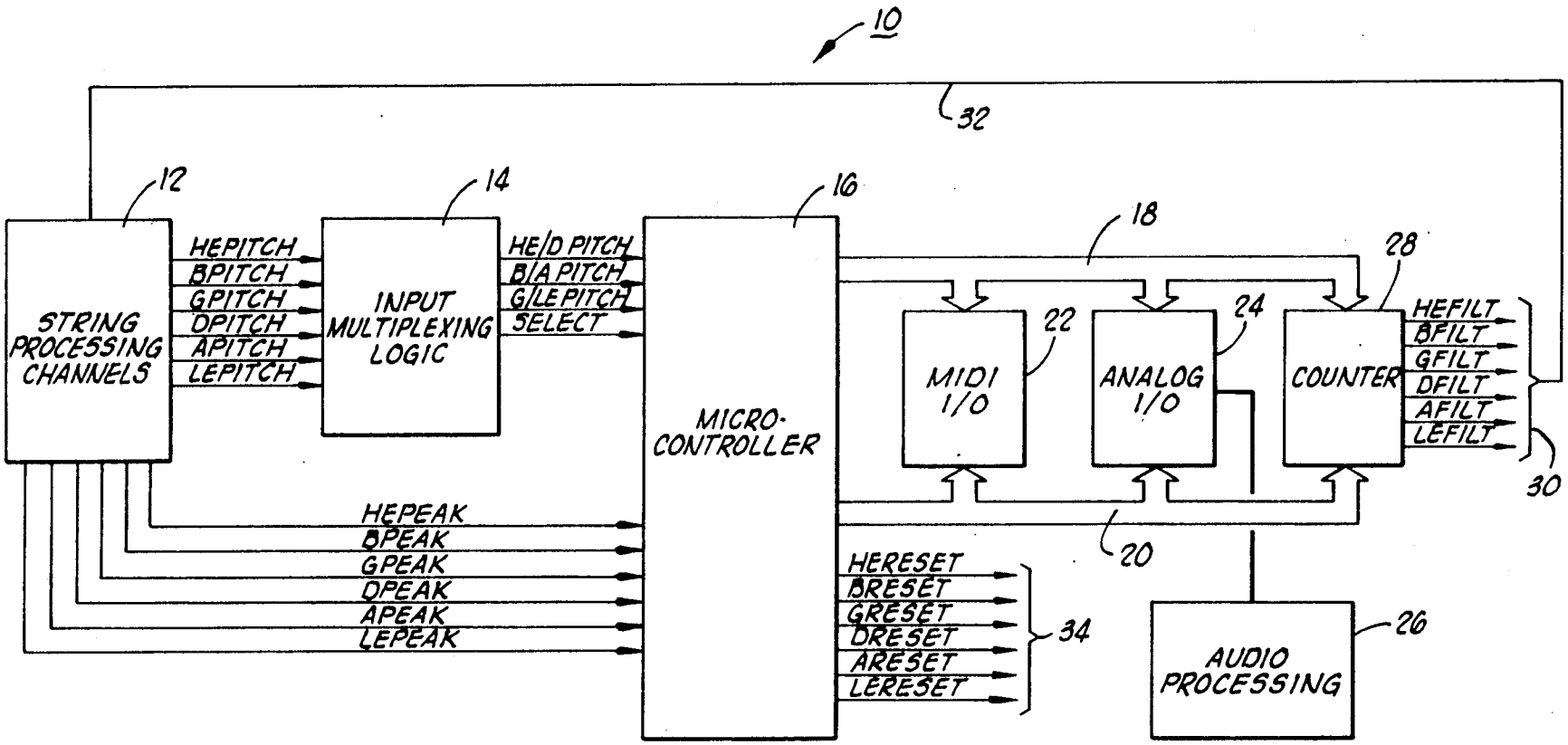
FIG. 1 is a block diagram of the guitar control system.

The guitar control system 10 includes a plurality of string processing channels 12, one channel for each guitar string. In the present discussion, six guitar strings are utilized and these are designated herein as HE (high end), B, G, D, A and LE (low end). Each of the string processing channels derived both a pitch output for input to input multiplexing logic circuitry 14, and they derive a peak output for input to a microcontroller 16.

The microcontroller 16 communicates by means of busses 18 and 20 with a parallel array of circuitry. The MIDI input/output circuitry 22 provides the interface to the synthesis equipment wherein the music or tone selective sound is generated, and an analog input/output array 24 provides output connection to the final audio processing circuitry. A counter circuit 28 provides a plurality of string channel filter outputs 30 and these are fed back via line 32 for input to the individual string processing channels wherein they function as a clock controller, as will be further described. The microcontroller 16 also provides string channel reset pulses 34.

Figure 2A:
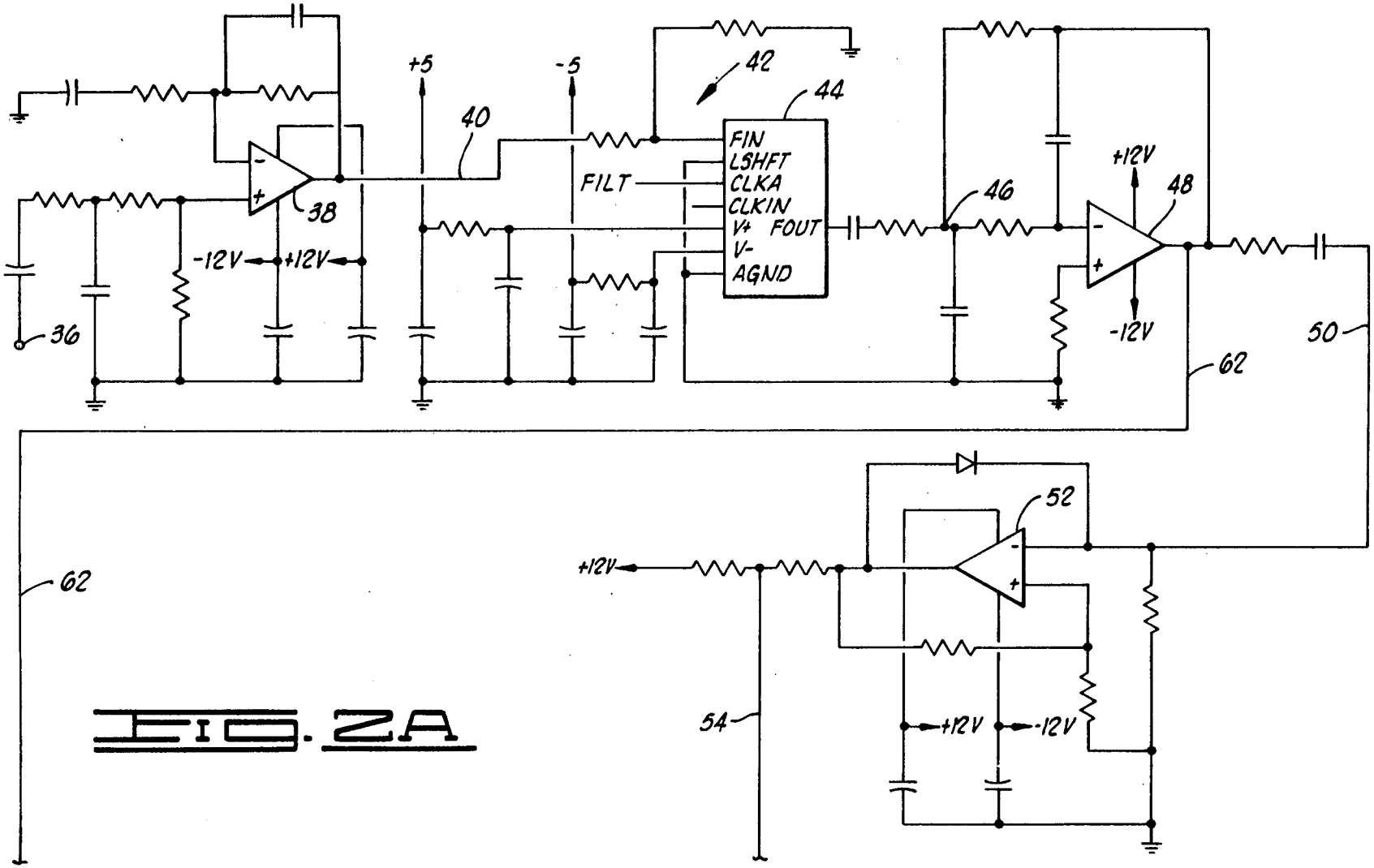
FIG. 2A is a schematic diagram of a first part of the string channel peak detection circuitry.

Referring now to FIG. 2A, guitar string input is applied at input terminal 36 for input to a buffer and filter amplifier 38, IC-type TL072P. The input to terminal 36 is derived from a hexaphonic magnetic pickup mounted on the guitar controller. Thus, there is a pickup adapted to transmit the characteristic acoustic signal for each of the strings LE through HE, and each of these string inputs is separately applied to its own individual string processing channel such as that of FIGS. 2A and 2B.

String input at terminal 36 is then applied to the filter amplifier 38 which functions as an input buffer and an anti-aliasing filter. Output from filter amplifier 38 is then applied via lead 40 to a harmonic rejection filter 42. The harmonic rejection filter 42 consists of a type XR1003CP integrated circuit 44 that receives the output on lead 40 at pin 8, and a filter clock input at pin 2 thereby to provide a filtered output at pin 5. The filter clock is derived for the respective string channel in counter 28 as previously described (FIG. 1).

Output from the harmonic rejection filter 42 is then coupled through junction 46 to a reconstruction filter amplifier 48, another section of an IC-type TL072P. Output from reconstruction filter 48 is via line 50 to a negative peak detector 52, IC-type 4LM1458N. A negative peak signal output is then present on a lead 54.

Figure 2B:
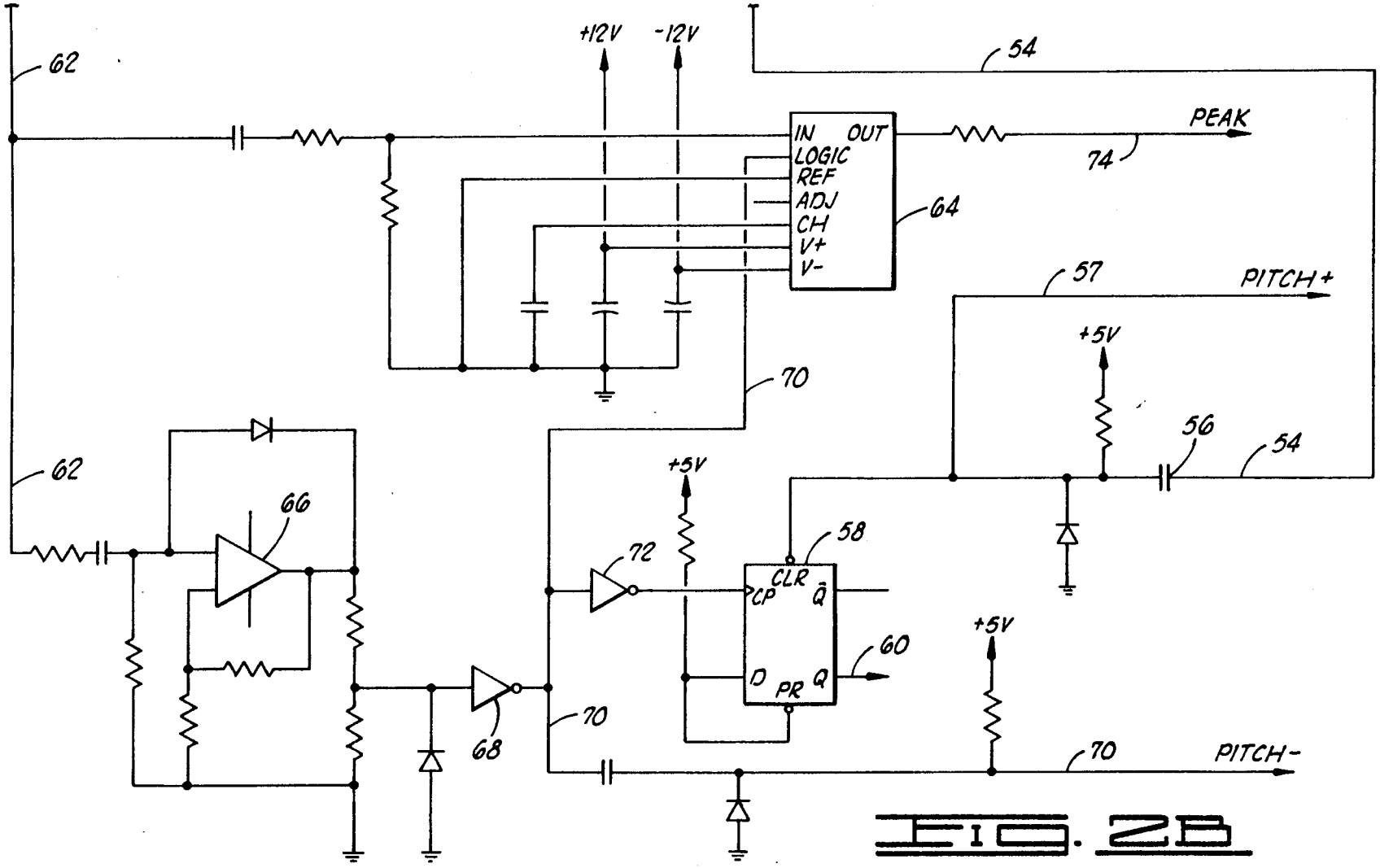
FIG. 2B is the second part of the peak detection circuitry.

Referring now to FIG. 2B, the peak signal on lead 54 is coupled through a capacitor 56 whereupon a PITCH PLUS signal is present on a lead 57 and the signal is also applied to the CLEAR input of a FLIP FLOP 58, a peak de-glitcher, IC-type 74C74N. A SET pulse on Q output 60 provides the de-glitching function.

Referring also to FIG. 2A, a second output lead 62 from filter amplifier 48 is applied in FIG. 2B to both a positive peak track/hold circuit 64 and a positive peak detector 66. The positive peak detector 66, a section of IC-type 4LM1458N, provides output to an inverter 68 to lead 70 as the PITCH MINUS signal. The PITCH MINUS signal on lead 70 is passed through another inverter 72 for input to the CP terminal of FLIP FLOP 58 as well as to the track/hold circuit 64 at logic input pin 8. The track/hold circuit 64 is an IC-type LF398N which receives input from lead 62 at pin 3, the logic input from lead 70 at pin 8, reference input at pin 7 and it provides a PEAK output on lead 74.

Figure 3A:
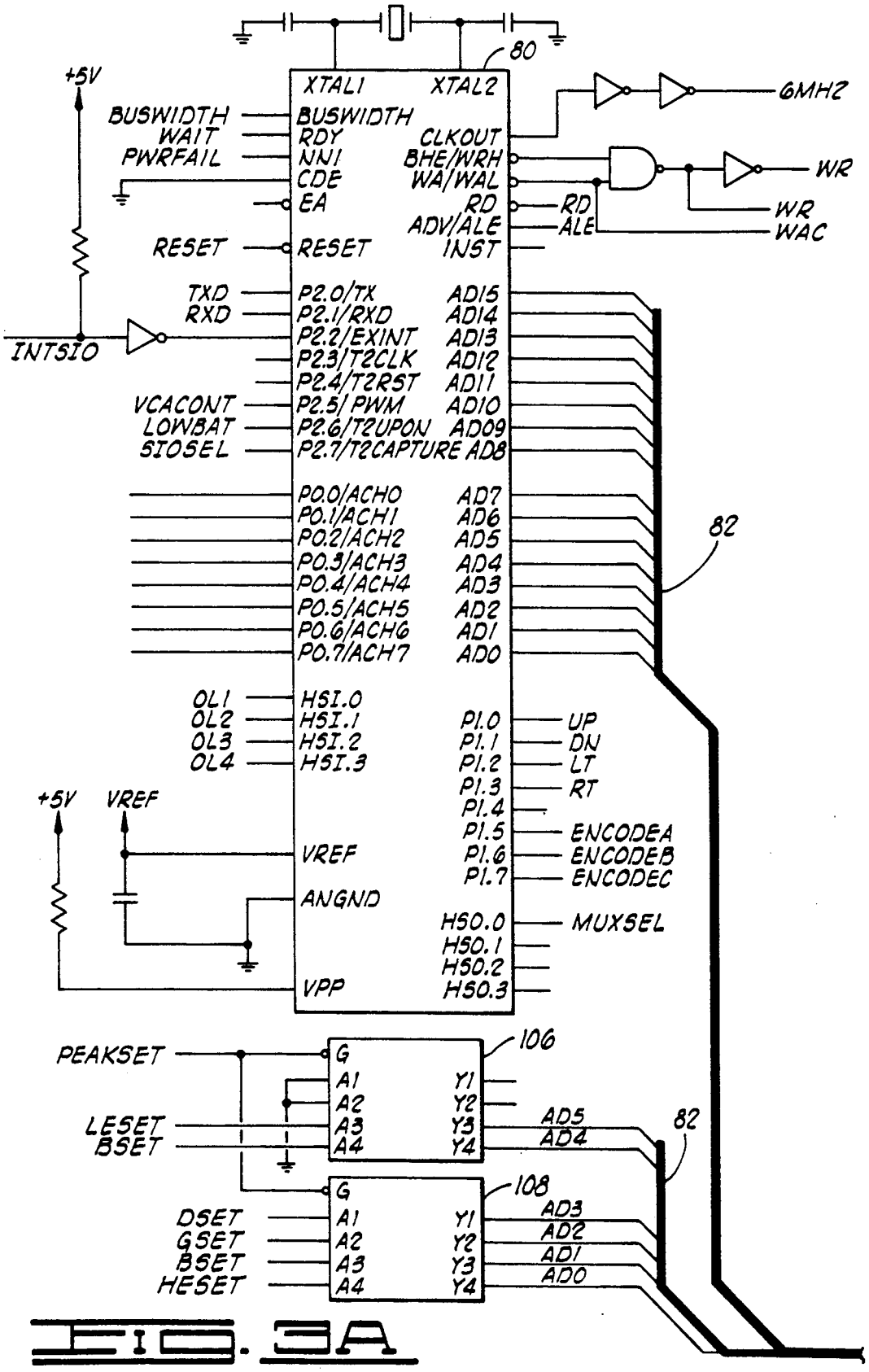
FIGS. 3A, 3B and 3C are a schematic diagram of the microprocessor control section.
Figure 3B:
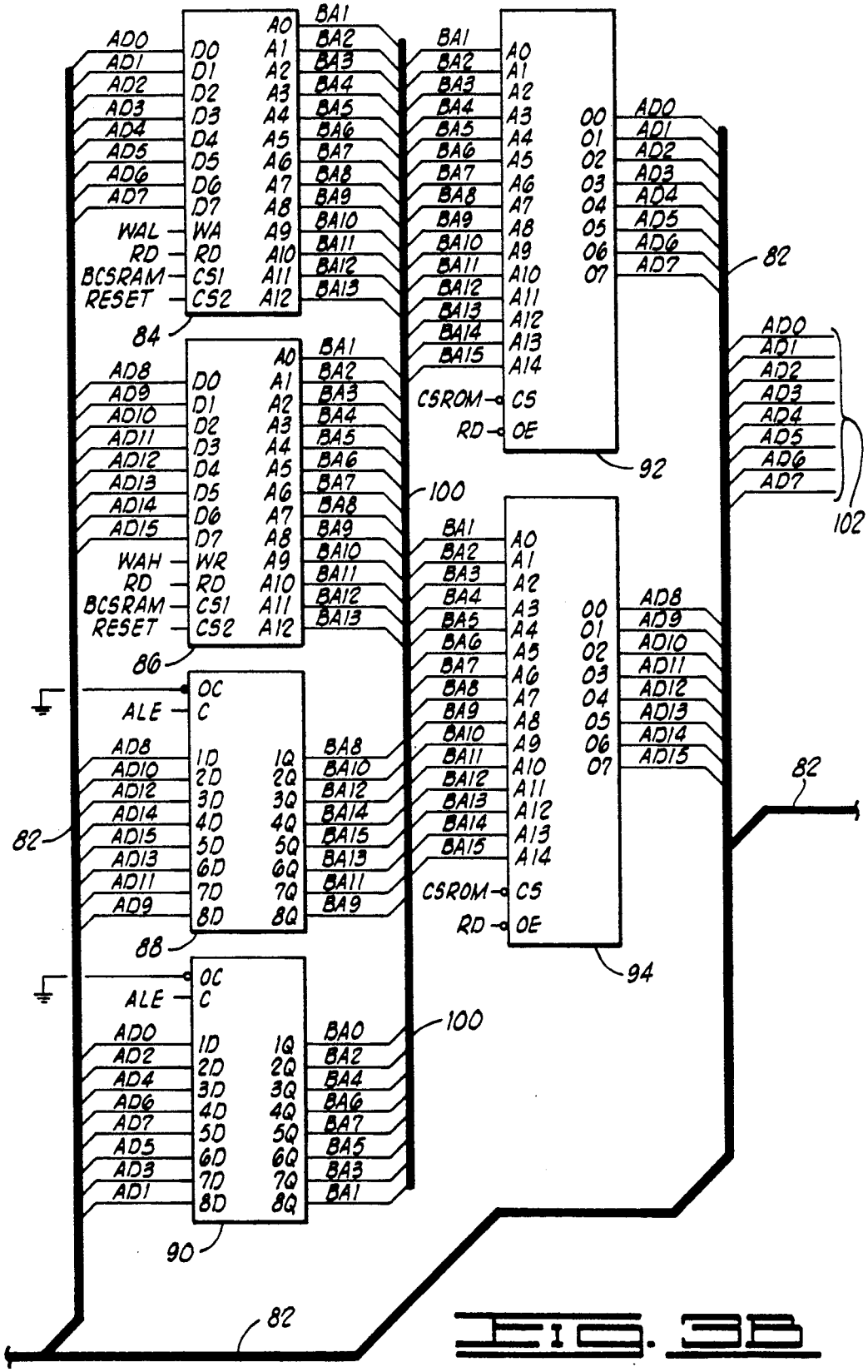
Figure 3C:
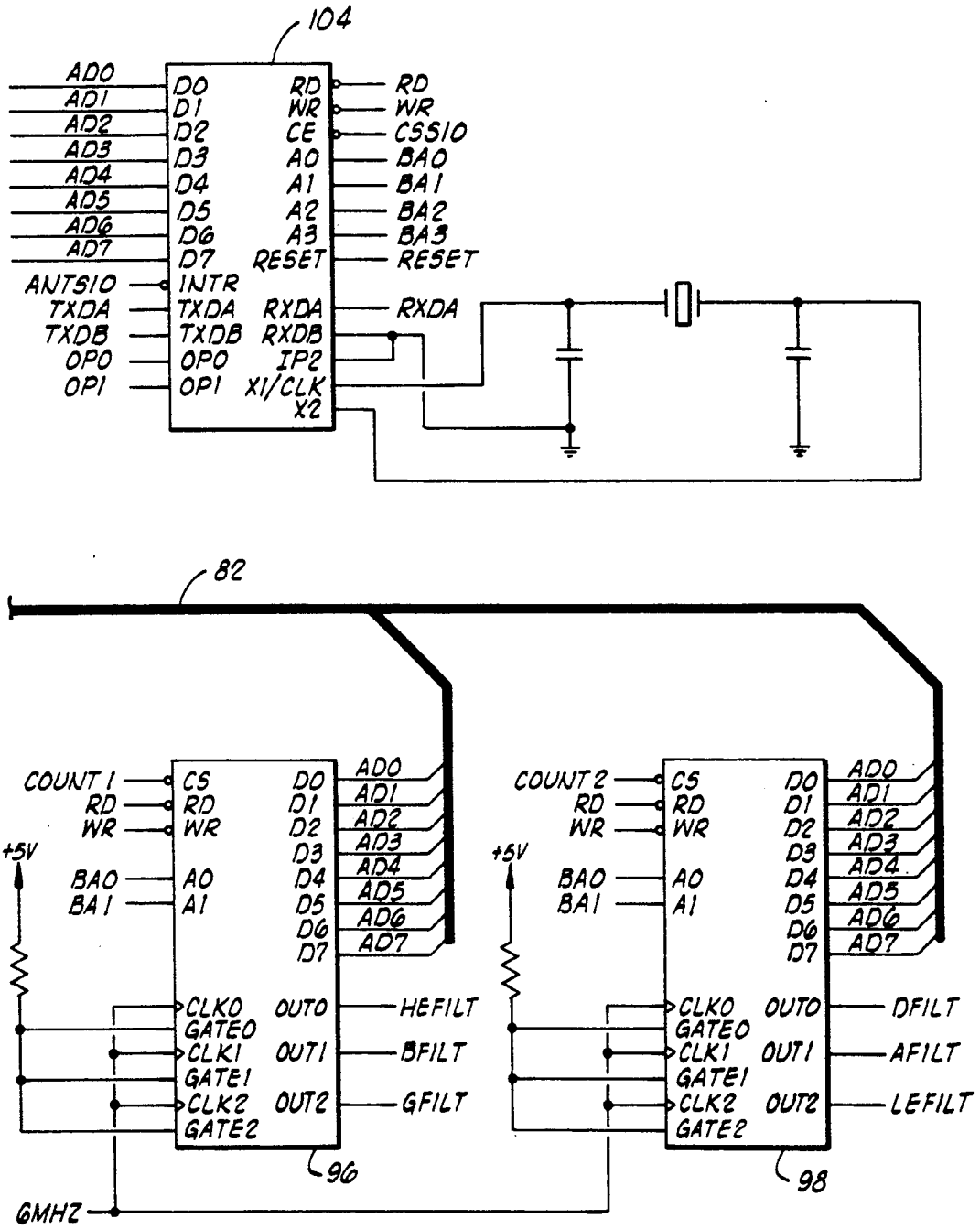

FIGS. 3A and 13B and 3C illustrate the system central processing unit as it is based upon a microprocessor 80, an INTEL type 80C196 integrated circuit. The central processing unit (FIGS. 3A and 13B and 3C handles all front panel controls, MIDI communications, pitch conversion and includes a proprietary ½ duplex serial communications link for communications with the foot controller (not shown). Therefore are also many allowances for future product expansion. The microprocessor 80 communicates with the AD (Address/Data) buss 82 for interconnection with each of data RAMS 84 and 86, IC types 62LP64-15, and address latches 88 and 90, IC types 74AC373N. The AD buss 82 is also connected to a pair of program EPROMS 92 and 94, IC types 27C255-20, and on Fig. 3C the AD buss 82 connects to a pair of filter control counters 96 and 98, IC types 82C54. A BA buss 100 provides interactive connection between the EPROMS 92, 94 and the data RAMS 84, 86 and address latches 88, 90. Finally, the AD buss 82 provides eight-lead connection 102 to a serial interface 104 (see FIGS. 13B and 3C), an IC type SCN2681AC1N28.

The program for the microprocessor 80 resides in 32K bytes of EPROM residing in EPROMS 92 and 94 and configured as 16K bytes of 16-bit program memory and 32K bytes of static RAM. The memory map is as follows:

| Address | Description | Buswidth | WaitStates |
|---|---|---|---|
| | Memory Map | | |
| 0FFFFH | Program & Data RAM | 0 | 1 |
| 08000H | | | |
| 07FFFH | Program EPROM | 1 | 1 |
| 02000H | | | |
| 01FFFH | I/O See I/O Map | 0 | 3 |
| 00100H | | | |
| 000FFH | Monitor NMI Routine | 0 | 1 |
| 00000H | | | |
| | I/O ADDRESSING | | |
| 01120H-01123H | Display | 0 | 3 |
| 01124H-01127H | Peakset | 0 | 3 |
| 01128H-0112BH | FxSwitch | 0 | 3 |
| 0112CH-0112FH | VcaMux | 0 | 3 |
| 01130H-01133H | Countl | 0 | 3 |
| 01134H-01137H | Countl | 0 | 3 |
| 01138H | TestPort1 | 0 | 3 |
| 0113CH | TestPort2 | 0 | 3 |
| 01140H-01143H | DUART | 0 | 3 |

A portion of AD buss 82 is also applied to peak READ-BACK buffer circuits 106 and 108, IC types 74HC244N. The port PO inputs to microprocessor 80 are from the individual string peak signals as derived on lead 74 of FIG. 2B. Such a peak signal on a lead 74 is developed for each of guitar strings HE through LE and each such signal is applied to a selected one of ports PO of microprocessor 80. The OL1–4 signals as applied to the HSI inputs of microprocessor 80 are developed in the high speed input multiplexer, as will be further described below.

Figure 4:
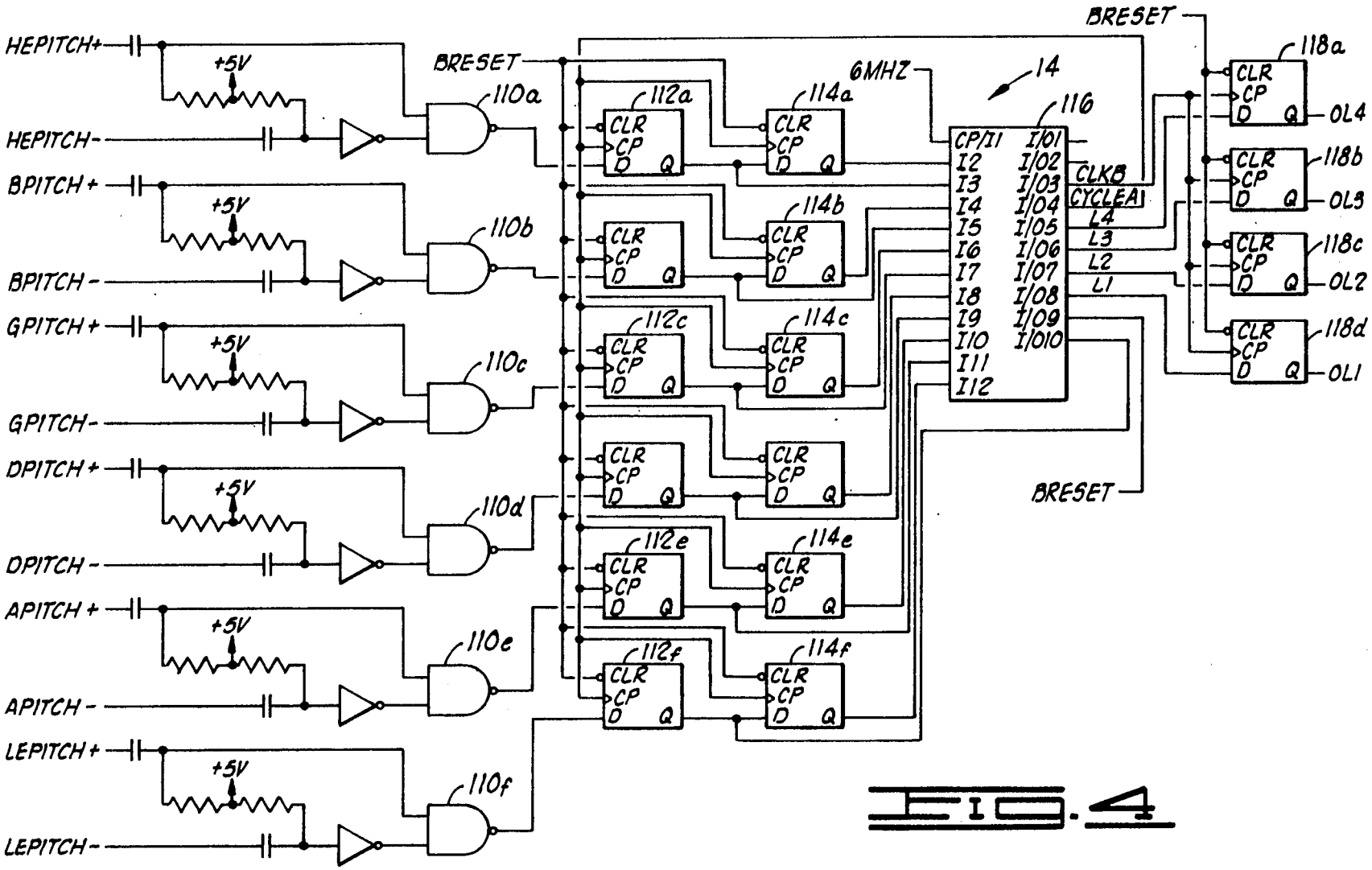
FIG. 4 is a schematic diagram of a high-speed input multiplexing circuit of the invention.

Referring now to FIG. 4, there is illustrated the high speed input multiplexer 14 (FIG. 1). The high speed multiplexer 14 receives PITCH+ and PITCH− for input for each of guitar strings HE-LE and each is conducted through an inverting gate 11O*a–f* (IC types 74C132N). An inverted PITCH SIGNAL is then applied to respective pairs of FLIP FLOPS 112*a–f* and 114*a–f* with respective outputs being applied to the inputs of an EPLD multiplex stage 116, IC type 22V10DC. The multiplexer 116 is programmed with the multiplexing logic as it divides the 6 Mhz clockout from microprocessor 80 into two phases 180° apart, CYCLE A and CYCLE B. Each cycle is synchronous with the processor 80 sampling the high speed input (HSI) unit as each cycle occurs once every sixteen "state" times. The EPLD multiplexer 116 outputs four bits of data, CYCLE A, L2, L3, L4, to a latch circuit 118*a* through 118*d*. The latched outputs from latches 118, type 74C174N FLIP FLOPS, are the respective pulses OL1–OL4 on the rising edge of CLOCK B from EPLD 116 for presentation to the HSI unit of microprocessor 80.

The upper three bits OL2, OL3 and OL4 represent peaks from the peak detectors (FIG. 2B). That is, HIE, B, G during CYCLE A and D, A, LE during CYCLE B, and the first bit OL1 represents the cycle, a high level for CYCLE A and a low level for CYCLE B. The input multiplexing logic is designed so that if no new edges occur on the input data, then no new events are presented to the microprocessor 80. The time between the positive and negative peaks can thus be measured, and subsequently the pitch of the incoming note and the MIDI note number can be determined. The HSI events are recorded by the microprocessor 80 in an 8-level deep, 20-bit wide FIFO. The FIFO contains the status of OL1, OL2, OL3 and OL4 at the occurrence of the event as well as at the time of the event. When microprocessor 80 services the HSI interrupt, it uses the storage status information to determine which guitar string caused the interrupt, and the peak status latch is then read to determine the polarity of the peak. The pitch period is then calculated from the difference between the time of this peak and the time of the previous peak of the same polarity. If that peak is positive, then the processor reads the amplitude presented to it by the track/hold stage 64 (FIG. 2B).

The program for the 6-to-4 high speed multiplexer 116 is as follows:

```
/** Inputs **/
Pin 1 = 6MHZ          ; /*REGISTER CLOCK*/
Pin 2 = A1H           ; /*                    */
Pin 3 = A1L           ; /*                    */
Pin 4 = A2H           ; /*                    */
Pin 5 = A2L           ; /*                    */
Pin 6 = A3H           ; /*                    */
Pin 7 = A3L           ; /*                    */
Pin 8 = B1H           ; /*                    */
Pin 9 = B1L
Pin 10 = B2H
Pin 11 = B2L
Pin 13 = B3H
Pin 14 = B3L
Pin 15 = BRESET
/** Outputs **/
Pin 16 = L1           ; /*                    */
Pin 17 = L2           ; /*                    */
Pin 18 = L3           ; /*                    */
Pin 19 = L4           ; /*                    */
Pin 20 = CYCLEA       ; /*                    */
Pin 21 = CLKA         ; /*                    */
Pin 22 = Q1           ; /*                    */
Pin 23 = Q2           ;
/**  Declarations and Intermediate Variable Definitions          **/
/*   The inputs A1L and A1H are separated by a 6 Mhz             *
*    clock cycle.
*    → !A1L & A1H pulses at the +ve going edge of A1L            *
*    This version of the algorithm thus gives channel            *
*    requests on positive going edges of the input               *
*/
CHA1_REQ = (!A1H & A1L);
CHB1_REQ = (!B1H & B1L);
CHA2_REQ = (!A2H & A2L);
CHB2_REQ = (!B2H & B2L);
CHA3_REQ = (!B3H & B3L);
CHA_REQ = (CHA1_REQ # CHA2_REQ # CHA3_REQ);
/** Logic Equations **/
PRESET.OE = 'B'O;
B3L.OE = 'B'0;
Q1.SP = 'B'0;
Q1.AR = 'B'0;
Q1.OE = 'B'1;
Q2.SP = 'B'0;
Q2.AR = 'B'0;
Q2.OE = 'B'1;
CLKA.SP = 'B'0;
CLKA.AR = 'B'0;
CLKA.OE = 'B'1;
CYCLEA.OE = 'B'1;
CYCLEA.AR = 'B'0;
CYCLEA.SP = 'B'0;
Q1.D = !(Q1);
Q2.D = ((Q1 & !Q2) # (!Q1 & Q2));
CLKA.D = ((!Q2 & CLKA) # (!Q1 & CLKA) # (Q1 & !CLKA &
        Q2));
CLCLEA.D = ((!CLKA & CYCLEA) # (!Q2 & CYCLEA) #
          (CYCLEA & !Q1) # (!CLCLEA & Q1 & Q2 &
          CLKA));
L1.OE = 'B'1;
L2.OE = 'B'1;
L3.OE = 'B'1;
L4.OE = 'B'1;
L4 = ((CHA3_REQ & CYCLEA & !BRESET) #
     (CHB3_REQ & !CYCLEA & !BRESET));
```

-continued

```
L3 = ((CHA2_REQ & CYCLEA & !BRESET) #
     (CHB2_REQ & !CYCLEA & !BRESET));
L2 = ((CHA1_REQ & CYCLEA & !BRESET) #
     (CHB1_REQ & !CYCLEA & !BRESET));
L1 = (CHA_REQ & CYCLEA & !BRESET);
```

Figure 5:
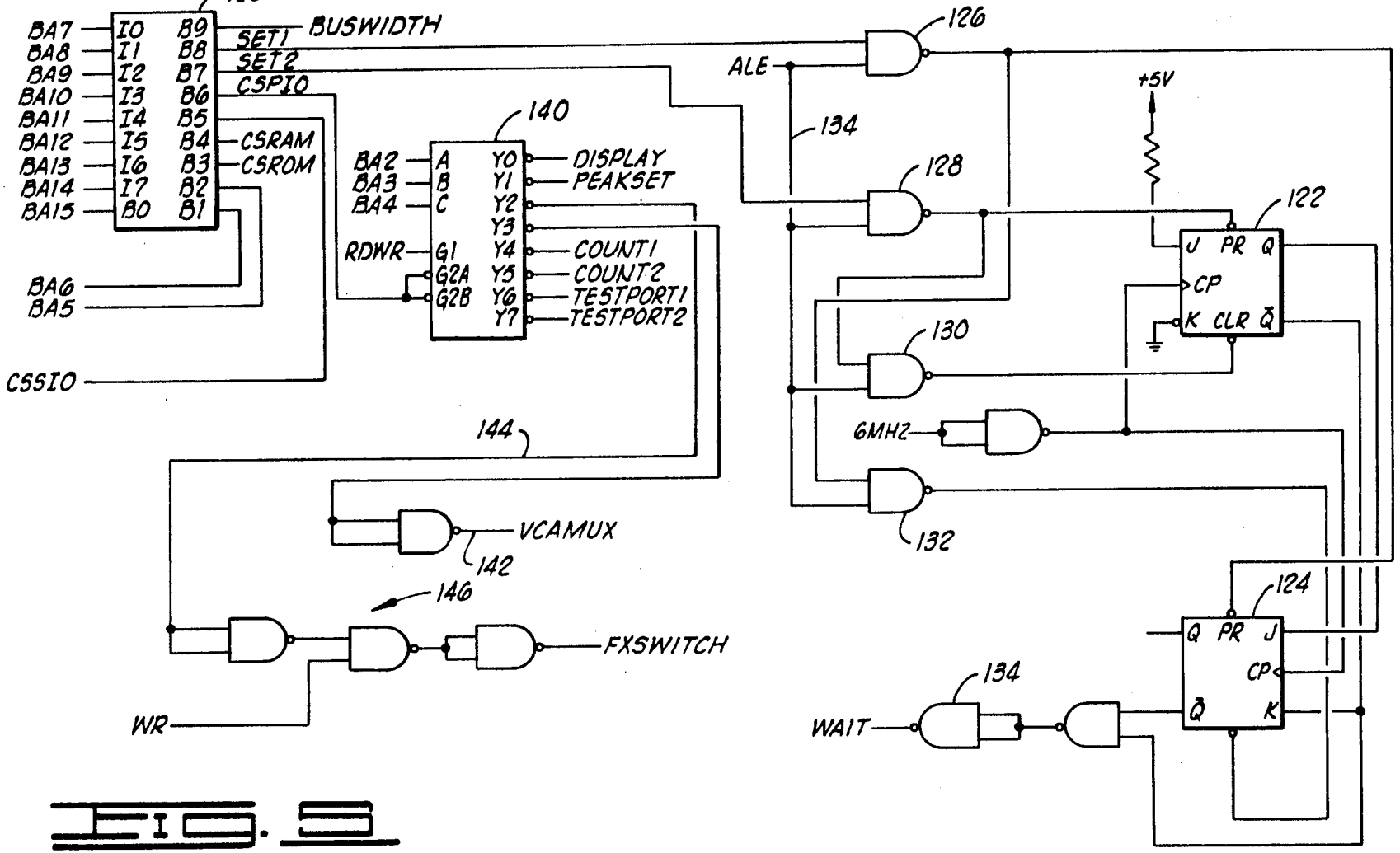
FIG. 5 is a schematic diagram of the memory address decoding and weight state generator circuitry.

Referring to FIG. 5, the memory address decoding circuit consists of a memory decoder 120, a type PLS153 logic device, which also controls the BUS-WIDTH line to microprocessor 80 to allow dynamic configuration of the buss. The microprocessor 80 (FIG. 3A) executes program and data cycles on a full 16-bit buss for speed. Peripherals occupy the lower byte of the 16-bit data word on an effective 8-bit buss.

The logic device 120 also controls WAIT state generation and can be configured to insert 0, 1, 2 or 3 WAIT states during program, data or I/O cycles. Two outputs from the logic device 120 determine how many WAIT states are generated during a given memory access. Outputs SET 1 and SET 2 are gated to the PRESET and CLEAR inputs of the JK FLIP FLOPS 122 and 124 by means of inverter gates 126, 128, 130 and 132. A logic high on ALE from the microprocessor 80 as applied to gates 126–132 via lead 134 enables the gates. If SET 1 is low during ALE, the FLIP FLOP 122 will be cleared, and if SET 2 is low during ALE, the FLIP FLOP 124 will be cleared. In effect, the cascaded JK FLIP FLOPS form a 2-bit counter and their outputs are decoded by the inverter gate array 126–132 to drive the READY input of microprocessor 80 high whenever both outputs of the counter FLIP FLOPS 122, 124 are low. The counter is clocked by the trailing edge of the processor 6 Mhz output which occurs when the sample window of the READY input of microprocessor 80 closes.

The WAIT states are selected in the following manner:

0 WAIT state—SET 1 and SET 2 are low, both outputs of counter FLIP FLOPS 122 and 124 will be cleared and ALE and the READY line will be high. No chip select is assigned during 0 WAIT states.

1 WAIT state—SET 1 and SET 2 are high, both outputs of the counter FLIP FLOPS 122 and 124 are preset during ALE and the READY Line will be driven low. CSRAM is assigned to 1 WAIT state.

2 WAIT states—SET 1 is low and SET 2 is high, output QA of the counter FLIP FLOPS is preset high and output QB is cleared low during ALE and the READY line will be driven low. The READY line will remain low until the counter is clocked twice by 6 Mhz causing counter outputs to increment and overflow to zero. CSROM is assigned to 2 WAIT states.

3 WAIT states—SET 1 is high and SET 2 is low, output QA of the counter is preset high and output QB is cleared low during ALE and the READY line will be driven low. The READY line will remain low until the counter is clocked three times by 6 Mhz causing the counter outputs to increment and overflow to zero. CSSIO and CSPIO are assigned to three WAIT states.

Output CSPIO from logic device 120 is applied into an integrated circuit 140, type 74C138N, which outputs a VCAMUX signal through an inverter gate 142. Another output on lead 144 through a gate inverter array 146 develops an FXSWITCH output for employ in the audio processing channels.

Figure 6:
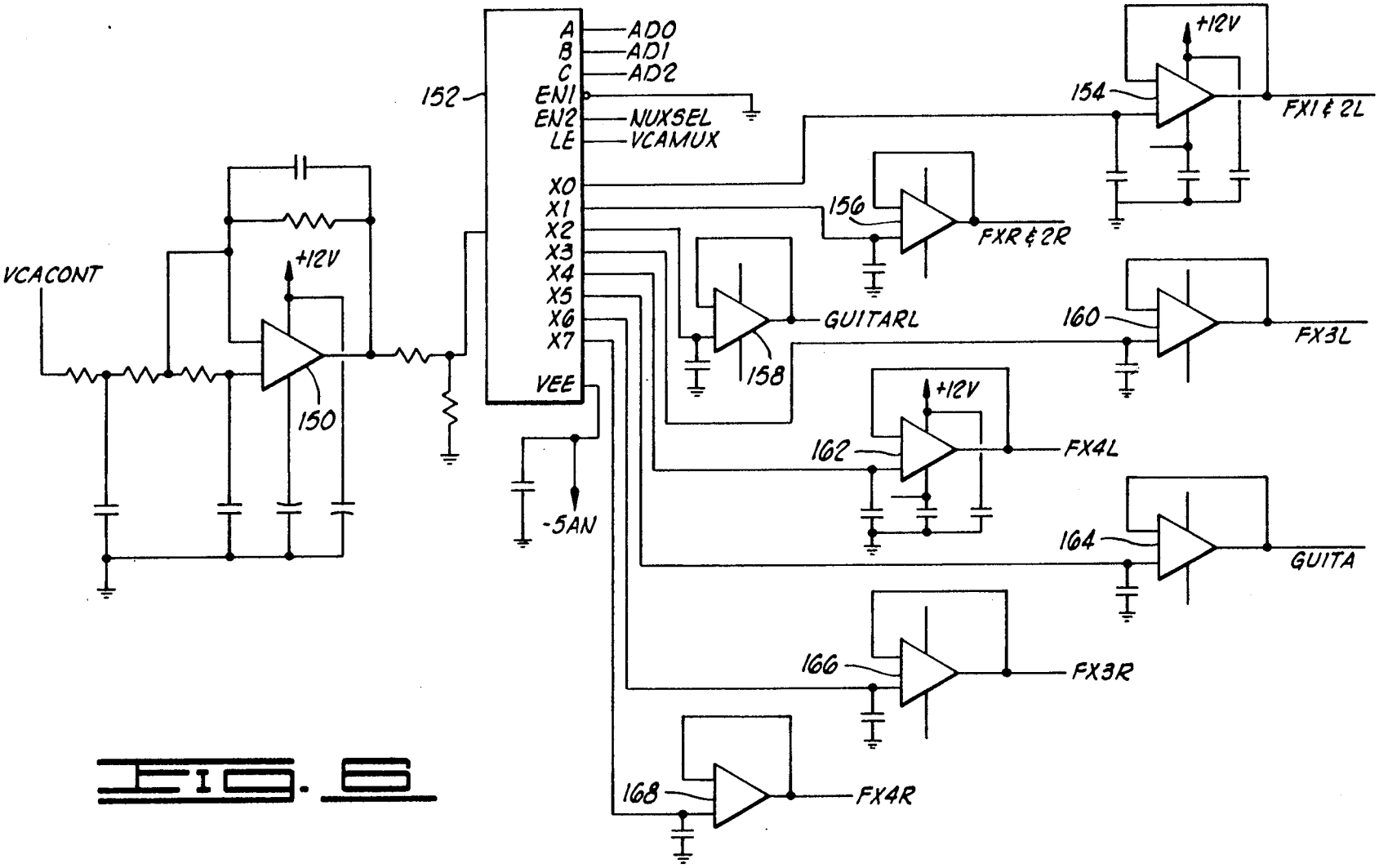
FIG. 6 is a schematic diagram of the pulse width modulation smoothing filter and voltage control track and hold circuitry of the present invention.

Referring to FIG. 6, output VCACONT from microprocessor 80 is applied to a voltage controlled amplifier 150 in the effects loops of the system. Effects levels are controlled in the system by voltage controlled amplifiers (VCA). Voltages are generated by the microprocessor 80 pulsewidth modulation output (PORT P2.5). This output is a 27K HZ square wave of varying duty cycle. It is smoothed by the pulse width modulation smoothing filter 150 which converts the square wave into a voltage from zero to five volts DC that is linearly proportional to the duty cycle of the pulsewidth modulator. The pulsewidth modulator is time division multiplexed by the microprocessor 80 and a control voltage multiplexer 152, an IC circuit type 74HC435. The multiplexer 152 thereby multiplexes eight different voltages onto the effects control voltage sample holds. Thus, outputs XO through X7 from multiplexer 152 are applied to one of the eight different effects control voltage sample holds comprised of type TLO74N amplifiers 154, 156, 158, 60, 162, 164, 166 and 168.

The voltage controlled amplifiers 154–168 control the various audio effects as generated through the audio processing circuitry 26. Audio processing and effects may be carried out in any of several known schemes. Thus, audio may be directed through left and right channels through serial EFX loops or parallel EFX loops and further processed through stereo output channels in well-known manner. Thus, as shown in FIG. 6, the voltage controlled amplifier 154 outputs effects 1 and 2 left, while amplifier 156 outputs effects 1 and 2 right. The amplifier 158 controls output of guitar left while amplifier 164 effects control of guitar right. Amplifiers 160 and 162 output effects 3 left and 4 left, respectively, and amplifiers 166 and 168 output effects 3 right and 4 right. Subsequent mixing of individual component signals is carried out by effects switching and amplification in well-known manner.

The foregoing discloses a MIDI guitar control system that can function to convert guitar signals to MIDI information for controlling any MIDI-equipped synthesizer. The control system is capable of controlling the levels and stereo position of four external effects loops as well as guitar amplification channel or reverberation selection. The pitch detection system utilized in the present system is optimized to extract the frequency of the fundamental of the guitar signal, i.e., the first harmonic, and the second and other upper harmonics of the input signal are attenuated by a programmable cut-off frequency filter.

The use of a programmable filter has two advantages. First, as perceptible tracking delays exist at low guitar frequencies, optimization of tracking delays is achieved by tuning the guitar to higher pitches and compensating for this in the pitch detection software before sending the note to the synthesizer. Previous systems have had the option of stringing the guitar with all strings being the same gauge, e.g., all strings tuned to high E (329.7 HZ - 3 ms). The present system allows the user to define his own tunings, such as Nashville-type tuning, which tunes the lower three strings an octave higher. This has the advantage that the guitar is tuned correctly, and normal guitar sound can be used in conjunction with the synthesizer sound. Second, with the tracking filters, an initial measurement of pitch can be made with the input filter set at an initial "guess" frequency. As more accurate pitch readings are made, the filters adjust to track the pitch and thus optimize the tracking.

The present control system takes advantage of information that is present in both positive and negative peak periods. The second harmonic is a problem in period detection, and the use of a peak period FLIP FLOP "locks out" the influence of the second harmonic on the period detection operation. Whereas prior types of pitch detectors have used custom VLSI or six hardware counters to implement pitch period counters, the present system takes advantage of the four high speed inputs (HSI) of the microprocessor as it is complemented by multiplexing logic to provide what may be called a cost effective system of period measurement.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A guitar control system comprising:
   - a multi-phonic string vibration pickup providing respective string outputs;
   - a plurality of string processing channels with harmonic rejection filter each receiving input of a respective string output and each generating a pitch output and a peak output;
   - input multiplexing means receiving each of said pitch outputs and providing a multiplexed output;
   - a programmed microprocessor receiving input of said multiplexed output and each of said peak outputs, and providing output of string related data on an address/data buss;
   - a midi interface connected to said buss for converting string related data for synthesizer input;
   - an analog input/output circuit connected to said buss;
   - a counter circuit connected to said buss and generating a filter output for each string, with each filter output being conducted back to the respective string processing channel for input to the respective harmonic rejection filter; and
   - audio processing circuitry receiving output from said analog input/output circuit and providing selected audio output.

2. A guitar control system as set forth in claim 1 wherein each of said string processing channels is further characterized to include:
   - an input buffer and anti-aliasing filter receiving said input and generating a first filtered output for input to said harmonic rejection filter; and
   - a reconstruction filter receiving input from said harmonic rejection filter and providing an output.

3. A guitar control system as set forth in claim 2 which is further characterized to include:
   - a negative peak detector receiving said reconstruction filter output to provide a negative peak output; and
   - a positive peak detector receiving said reconstruction filter output to provide a positive peak output.

4. A guitar control system as set forth in claim 2 which is further characterized to include:
   - a positive peak track/hold circuit receiving said reconstruction filter output and generating a peak signal for input to said microprocessor.

5. A guitar control system as set forth in claim 3 which is further characterized to include:
   - differentiating means receiving said negative peak output and generating a pitch plus signal;
   - second differentiating means receiving said positive peak output and generating a pitch minus signal; and
   - means for applying the pitch plus and pitch minus signals as inputs to said input multiplexing means.

* * * * *

UNITED STATES PATENT AND TRADEMARK OFFICE

CERTIFICATE OF CORRECTION

PATENT NO. : 5,140,890

DATED : August 25, 1992

INVENTOR(S) : Clifford S. Elion

It is certified that error appears in the above-identified patent and that said Letters Patent is hereby corrected as shown below:

Column 3, line 28, delete "and 13B" and insert --, 3B-- therefor.

Column 3, line 31, delete "and 13B" and insert --, 3B-- therefor.

Column 3, line 31, after "3C", insert --)--.

Column 3, line 42, delete "3C" and insert --3B-- therefor.

Column 3, line 48, delete "Figs. 13B and 3C" and insert --Fig. 3C-- therefor.

Column 5, line 61, delete "CLCLEA.D" and insert --"CYCLEA.D- therefor.

Column 7, line 21, delete "60" and insert --160-- therefor.

Signed and Sealed this

Fifth Day of October, 1993

*Attest:*

Bruce Lehman

BRUCE LEHMAN

*Attesting Officer*

*Commissioner of Patents and Trademarks*